US006233552B1

(12) United States Patent
Mustapha et al.

(10) Patent No.: US 6,233,552 B1
(45) Date of Patent: May 15, 2001

(54) ADAPTIVE POST-FILTERING TECHNIQUE BASED ON THE MODIFIED YULE-WALKER FILTER

(75) Inventors: Azhar Mustapha; Suat Yeldener, both of Germantown, MD (US)

(73) Assignee: Comsat Corporation, Bethesda, MD (US)

( * ) Notice: Subject to any disclaimer, the term of this patent is extended or adjusted under 35 U.S.C. 154(b) by 0 days.

(21) Appl. No.: 09/266,770

(22) Filed: Mar. 12, 1999

(51) Int. Cl.[7] ..... G10L 19/04
(52) U.S. Cl. ..... 704/209; 704/219
(58) Field of Search ..... 704/209, 219, 704/205, 207, 226, 227, 228

(56) References Cited

U.S. PATENT DOCUMENTS

| | | | | |
|---|---|---|---|---|
| 4,764,963 | | 8/1988 | Atal | 704/219 |
| 4,945,568 | * | 7/1990 | Willems | 704/209 |
| 5,054,085 | * | 10/1991 | Meisel et al. | 704/207 |
| 5,235,669 | * | 8/1993 | Ordentlich et al. | 704/200 |
| 5,615,298 | * | 3/1997 | Chen | 704/228 |
| 5,649,054 | | 7/1997 | Oomen et al. | 704/229 |
| 5,675,701 | * | 10/1997 | Kleijn et al. | 704/222 |
| 5,706,394 | | 1/1998 | Wynn | 704/219 |
| 5,708,754 | | 1/1998 | Wynn | 704/219 |
| 5,729,694 | * | 3/1998 | Holzrichter et al. | 705/17 |
| 5,778,338 | * | 7/1998 | Jacobs et al. | 704/223 |
| 5,781,883 | | 7/1998 | Wynn | 704/226 |
| 5,884,010 | * | 3/1999 | Chen et al. | 704/228 |
| 6,026,357 | * | 2/2000 | Ireton et al. | 704/207 |
| 6,041,297 | * | 3/2000 | Goldberg | 704/219 |

* cited by examiner

*Primary Examiner*—Richemond Dorvil
(74) *Attorney, Agent, or Firm*—Sughrue, Mion, Zinn, Macpeak & Seas, PLLC

(57) ABSTRACT

An adaptive time-domain post-filtering technique is based on the modified Yule-Walker filter. This technique eliminates the problem of spectral tilt in speech spectrum that can be applied to various speech coders. The new post-filter has a flat frequency response at the formant peaks of speech spectrum. Information is gathered about the relation between poles and formants and then the formants and their bandwidths are estimated. The information about the formants and their bandwidths is then used to design the modified Yule-Walker filter based on a least squares fit in time domain.

22 Claims, 7 Drawing Sheets

ADAPTIVE POST-FILTERING TECHNIQUE BASED ON THE MODIFIED YULE-WALKER FILTER

BACKGROUND OF THE INVENTION

A perfect post-filtering technique should not alter the formant information and should attenuate null information in the speech spectrum in order to achieve noise reduction and hence produce better speech quality. Conventionally, time-domain post-filtering techniques use modified LPC synthesis, inverse, and high pass filters that are derived from an LPC spectrum and are configured by the constants: $\alpha$ (for modified synthesis filter), $\beta$ (for modified inverse filter) and $\mu$ (for high pass filter). See, Juiun-Hwey Chen, Allen Gersho "Adaptive Post-filtering For Quality Enhancement of Coded Speech", IEEE Trans. Speech & Audio Proc., vol. 3, no. 1, pp. 59–71, 1995. Such a filter has been used successfully in low bit rate coders, but it is very hard to adapt the coefficients from one frame to another and still produce a post-filter frequency response without spectral tilt. The result is time-domain post-filtering which produces varying and unpredictable spectral tilt from one frame to another which causes unnecessary attenuation or amplification of some frequency components, and a muffling of speech quality. This effect increases when voice coders are tandemed together. However, it is very hard to adapt these coefficients from one frame to another and still produce a post-filter frequency response without spectral tilt. Conventional time-domain post-filtering produces varying spectral tilt from one frame to another affecting speech quality.

Another problem with conventional time-domain post-filtering is that, when two formants are close together, the frequency response may have a peak rather than a null between the two formants hence altering the formant information. Yet another effect is that in the original speech, the first formant may have a much higher peak than the second formant, however, the frequency response of the post-filter may have a second formant with a higher peak than the first formant. These phenomena are completely undesirable because they affect the output speech quality.

Another approach of designing a post-filter is described by R. McAulay, T. Parks, T. Quatieri, M. Sabin "Sine-Wave Amplitude Coding At Low Data Rates", Advances in Speech Coding, Kluwer Academic Pub., 1991, edited by B. S. Atal, V. Cuperman and A. Gersho, pp. 203–214. This technique has produced good performance without spectral tilt, but it can only be used in sinusoidal based speech coders.

SUMMARY OF THE INVENTION

It is, therefore, an object of the invention to provide a new time-domain post-filtering technique which eliminates the problems above, particularly the problem of spectral tilt in speech spectrum, and that can be applied to various speech coders, including both time and frequency domain speech coders.

This and other objects are achieved according to the present invention by a post-filter design approach which uses the pole information in the LPC spectrum and finds the relation between poles and formants.

The locations of poles of an LPC spectrum of said speech signal are determined, the location and bandwidth of formants of said speech signal are estimated based on the pole information, by first arranging the poles in a predetermined order (e.g., according to increasing radius) and applying an estimation algorithm to the ordered poles. The filter coefficients are estimated, a desired filter response characteristic is compared to the filter response characteristic resulting from said estimated filter coefficients to obtain a difference value, the filter coefficients are adjusted to minimize said difference value according to a least squares approach.

In accordance with a preferred embodiment of the invention, the formant estimation algorithm comprises calculating a magnitude and slope of said LPC spectrum at at least some of said arranged poles, calculating first and second slopes m1 and m2, respectively, of said LPC spectrum on either side of the arranged poles, and then (i) estimating first and second adjacent poles to represent different formants if m1 is less than zero and if m2 is greater than zero, (ii) estimating first and second adjacent poles to represent a common formant if the criteria of step (i) are not met and if a difference in magnitudes of said LPC spectrum is less than a threshold value, e.g., 3 dB, and (iii) estimating the larger of said first and second poles to represent a formant if the criteria of steps (i) and (ii) are not met. If the bandwidths assigned to adjacent formants in this process are overlapping, the formants are combined into a single bandwidth.

In accordance with the present invention, the filter is a Modified Yule-Walker (MYW) filter with a filter response given by:

$$\frac{B(z)}{A(z)} = \frac{b(1) + b(2)z^{-1} + \cdots + b(N)z^{-(N-1)}}{1 + a(1)z^{-1} + \cdots + a(N)z^{-(N-1)}} \tag{3}$$

where N is the order of the MYW filter. The (MYW) filter coefficients are estimated using a least squares fit in the time domain. The denominator coefficients of the filter (a(1), a(2), . . . , a(N)) are computed by the Modified Yule-Walker equations using non-recursive correlation coefficients computed by inverse Fourier transformation of the specified frequency response of the post-filter. The numerator coefficients of the filter (b(1), b(2), . . . , b(N)) are computed by a 4 step procedure: first, a numerator polynomial corresponding to an additive decomposition of the power frequency response is computed. The complete frequency response corresponding to the numerator and denominator polynomials is then evaluated. As a result, a spectral factorization technique is used to obtain the impulse response of the filter. Finally, the numerator polynomial is obtained by a least squares fit to this impulse response.

Test results show that the post-filter according to the present invention outperforms the conventional post-filter in both 1 and 2 tandem connection cases of the voice coders.

BRIEF DESCRIPTION OF THE DRAWING

The invention will be more clearly understood from the following description in conjunction with the accompanying drawing, wherein.

DETAILED DESCRIPTION OF THE PREFERRED EMBODIMENT

The filter according to the present invention uses a new time-domain post-filtering technique, and has a flat frequency response at the formant peaks of the speech spectrum. Instead of looking at the modified LPC synthesis, inverse, and high pass filtering in the conventional time-domain technique, the technique according to this invention gathers information about the poles of the LPC spectrum, uses this information to estimate formants and nulls, then uses the estimated locations of formants and number of poles for each formant to compute the bandwidths of the formants and eventually the frequency response of the desired post-filter.

Generally, pole angles in an LPC spectrum have information about formant locations and associated bandwidths. Given that an LPC spectrum is defined as $1/(1-A(z))$ where $A(z)=\Sigma_{i=1}^{M} a_i z^{-1}$ is the i-th LPC coefficient and M is the order of the LPC predictor, we can find the poles by solving for the roots of $1-A(z)$. In the preferred embodiment, a $14^{th}$ order LPC filter is assumed. In solving for the roots, $1-A(z)$ is turned into a companion matrix, e.g., as described by J. H. Wilkinson and C. Reinsch, "Linear Algebra: Hand Book for Automatic Computation" Springer-Verlag New York Heidelberg Berlin 1971. The companion matrix is used to find the eigenvalues which are the roots of $1-A(z)$. In finding the eigenvalues, QR (Q=Orthogonal columns and R=Upper triangular) algorithm for real Hessenberg matrices can be implemented, as described by Wilkinson et al.

Naturally, poles exist in conjugate pairs, although two real poles might exist. If two real poles exist, they always have an angle of 0 and $\pi$. Noting this symmetrical property, the poles can be divided into a group of positive angles and a group of negative angles. For each group, the radii can be arranged in descending order so that $r_1$ is the longest radius in the positive group and $r_8$ is the longest radius in the negative group. Notice also that the longest radius has the shortest distance to the unit circle since all the radii are less than 1. With this arrangement, $r_1$ and $r_8$ have the same radius and occur in conjugate angles.

Figure 1:
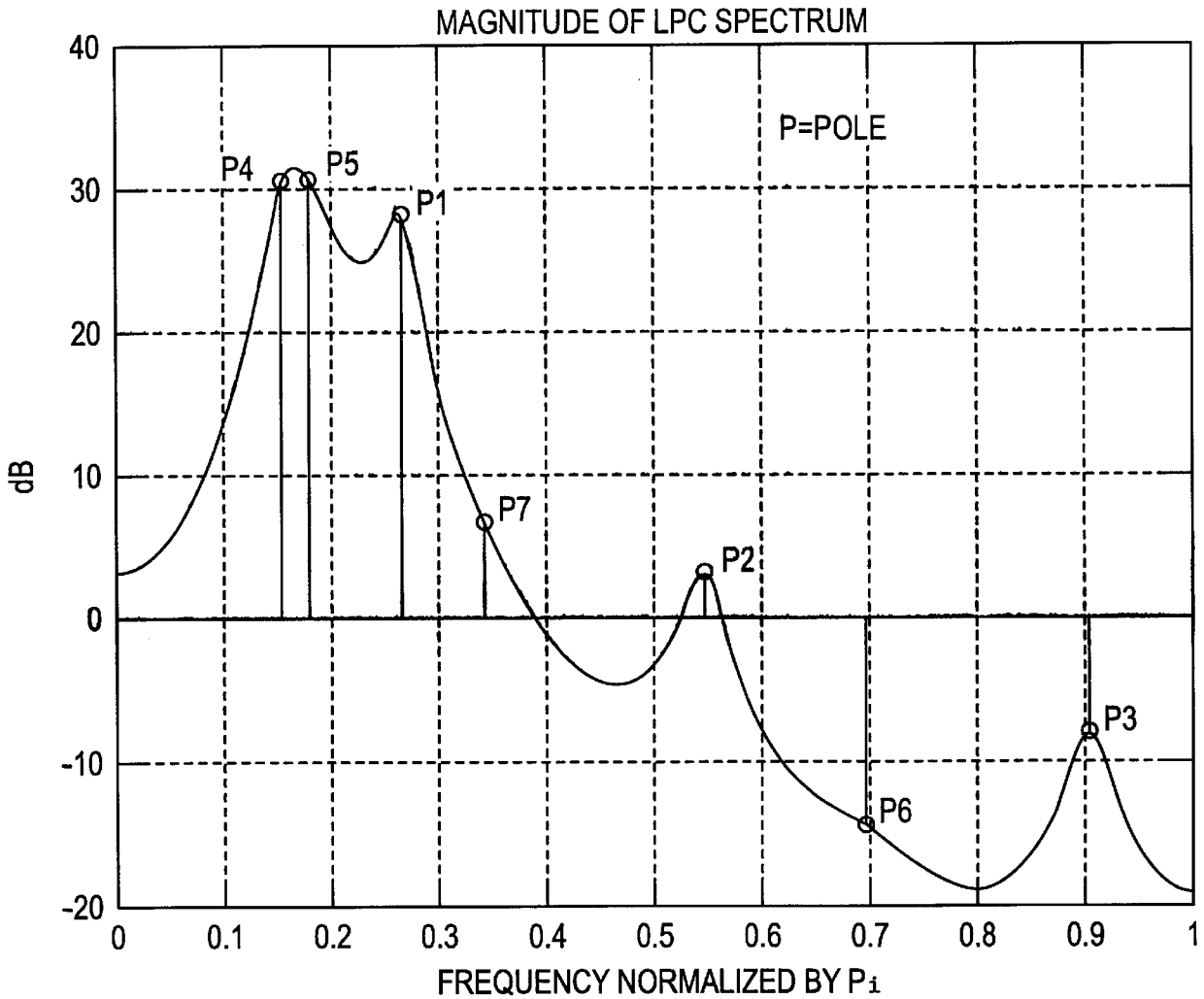
FIG. 1 is a diagram of poles and formants in a typical LPC speech spectrum.

To analyze the relation between poles and formants, a typical LPC spectrum is plotted with the pole angles located on the normalized frequency axis as shown in FIG. 1. In this figure, the locations of poles 1 through 7 are noted by P1 through P7. Poles P1, P2 and P3 indicate the exact locations of the formant peaks. However, the first 3 poles are not always located at the peaks as shown in this example. In general, a wide formant bandwidth has two or three poles that are close together. This fact can be observed in FIG. 1 where the bandwidth of the first formant is wider than the second formant. The first formant has poles P4 and P5 that are close together while the other formants only have a single pole. By observation in the example, 5 poles need to be considered to estimate the locations of formants and associated bandwidths. However, poles P6 and P7 are still considered because these poles might be a part of a formant themselves. With knowledge of the locations of the seven poles, estimation of the formants and nulls can begin.

Figure 2:
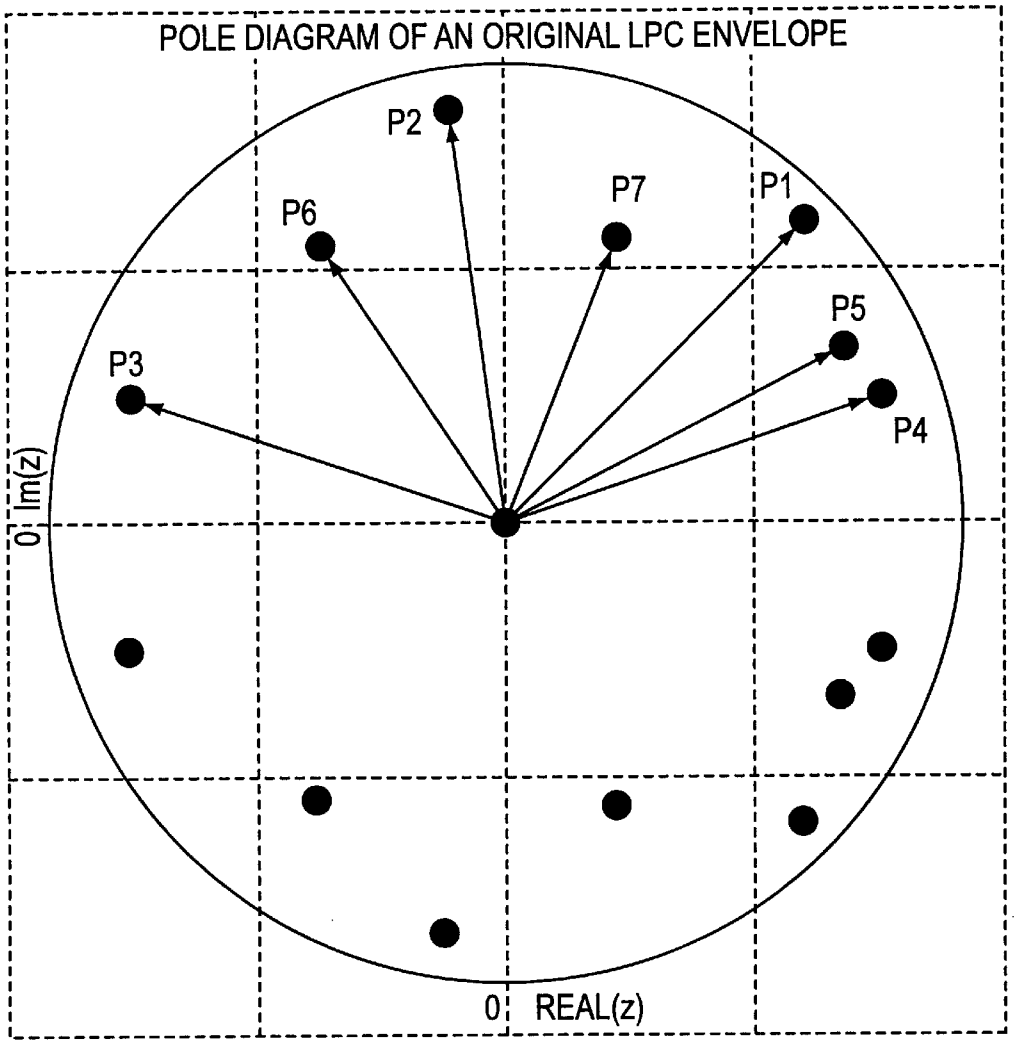
FIG. 2 is a diagram of the poles of the spectrum shown in FIG. 1.

In order to estimate formants and nulls, the following steps are followed. First, the positive angles of the poles are arranged in ascending order. The negative angles are omitted due to the symmetrical property of the angles as mentioned previously. This arrangement may be as generally illustrated in FIG. 2. The magnitude response for any given angle, $\omega$ is then computed as:

$$H(\omega)=\Pi_{i=1}^{14}\sqrt{1+r_i^2-2r_i\cos(\phi)} \tag{1}$$

where $r_i$ is the radius of pole $P_i$ and $\phi=\theta_i-\omega$; $\omega$ is any given angle, $\theta_i$ is the angle of the pole $P_i$ and 14 is the order of the filter In the next step, the backward and forward slopes of the neighboring angles are computed as:

$$m_1=H(\theta_i+\delta\omega)-H(\theta_i)$$

$$m_2=H(\theta_{i+1})-H(\theta_{i+1}-\delta\omega) \tag{2}$$

where $m_1$ and $m_2$ are the $i^{th}$ forward and $(i+1)^{th}$ backward slopes of the two neighboring angles, respectively and $\delta\omega$ is perturbation factor for each angle. The computed slopes of the neighboring angles are then compared. If $m_1<0$ and $m_2>0$, then it is assumed that a null between two angles exist and these two poles are treated as two independent formants. If the above condition is not satisfied, then the magnitude responses of the angles are compared. In this case, if $|H(\theta_i)-H(\theta_{i+1})|<3$ dB, then both of these poles are treated as one formant. Otherwise, the pole with larger magnitude response is treated as a formant. 3 dB was determined experimentally to be the optimal threshold. This process is repeated throughout all positive angles and hence all formants and nulls are estimated.

Estimated formant locations and number of poles for each formant are then used to compute the bandwidths of the formants and eventually the frequency response of the desired post-filter. In the case of a formant with a single pole, the bandwidth of the corresponding formant is set to be $2\delta b$, where $\delta b=0.04\pi$. For example, if the formant pole is assumed to be at $\theta_1$, then the bandwidth of the corresponding formant will cover the frequency range from $\theta_1-\delta b$ to $\theta_1+\delta b$. In the example shown in FIG. 1, poles P1, P2 and P3 are the single pole formants.

In the case of a formant with multiple poles (2 or 3 poles), the bandwidth of the corresponding formant should cover all of the corresponding pole locations. According to the example given in FIG. 1, poles P4 and P5 correspond to the first formant of the spectrum and the bandwidth of this formant ranges from $\theta_4-\delta b$ to $\theta_5+\delta b$, where $\theta_4$ and $\theta_5$ are the locations of poles P4 and P5 respectively. During estimation of formants and their bandwidths, the bandwidth of 2 formants might overlap each other when 2 formants are very close. This overlapping creates a problem in designing this post-filter. In order to avoid this problem, the bandwidths of these two formants are combined together to form only one band.

Figure 3:
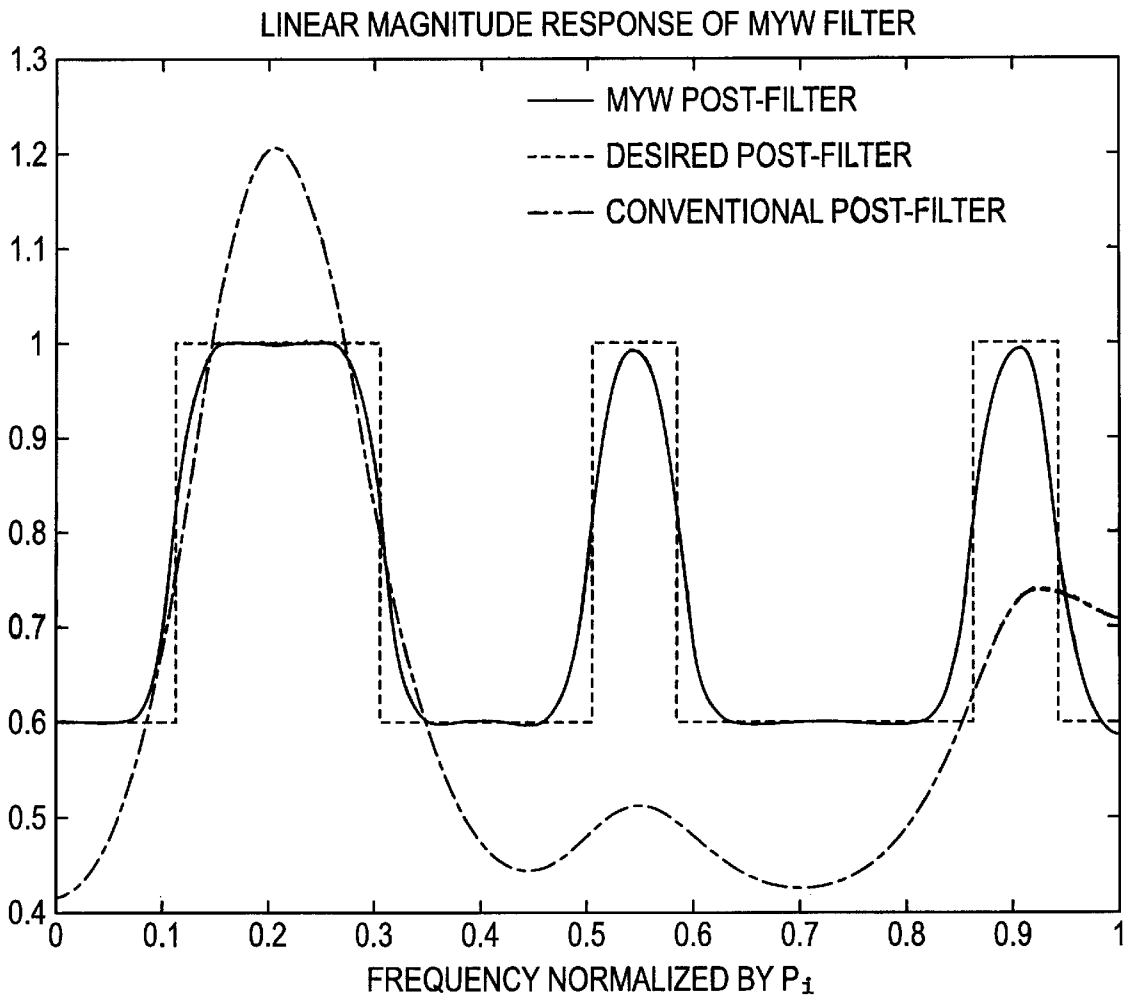
FIG. 3 is an illustration of the frequency response of a post filter in accordance with the present invention compared to a desired post filter and a conventional post filter.

In this post-filter, the aim is to preserve the formant information. Therefore, the post-filter will have a unity gain on the formant regions of the spectrum. Outside of the formant regions, the aim is to have some controllable attenuation factor, $\tau$ that controls the depth of the post-filtering. In our example, we set $\tau=0.6$. However, $\tau$ can be adapted from one frame to another depending on how much post-filtering is needed and the type of speech coder used. The frequency response of the desired post-filter is shown in FIG. 3 for the envelope illustrated in FIG. 1.

In order to design a post-filter to have the features mentioned above, an adaptive multi band pass filter is required. Such an adaptive multi band pass filter can be implemented using a modified Yule-Walker (MYW) recursive filter. The form of this filter can be formulated as:

$$\frac{B(z)}{A(z)}=\frac{b(1)+b(2)z^{-1}+\cdots+b(N)z^{-(N-1)}}{1+a(1)z^{-1}+\cdots+a(N)z^{-(N-1)}} \tag{3}$$

where N is the order of the MYW filter. The (MYW) filter coefficients are estimated using a least squares fit in the time domain. The denominator coefficients of the filter (a(1),a(2), . . . , a(N)) are computed by the Modified Yule-Walker equations using non-recursive correlation coefficients computed by inverse Fourier transformation of the specified frequency response of the post-filter, as described by Friedlander and Porat, cited above. The numerator coefficients of the filter (b(1), b(2), . . . , b(N)) are computed by a 4 step procedure: first, a numerator polynomial corresponding to an additive decomposition of the power frequency response is computed. The complete frequency response corresponding to the numerator and denominator polynomials is then evaluated. As a result, a spectral factorization technique is used to obtain the impulse response of the filter. Finally, the numerator polynomial is obtained by a least squares fit to this impulse response. A more detailed description of this algorithm is given by Friendlander and Porat.

Figure 4:
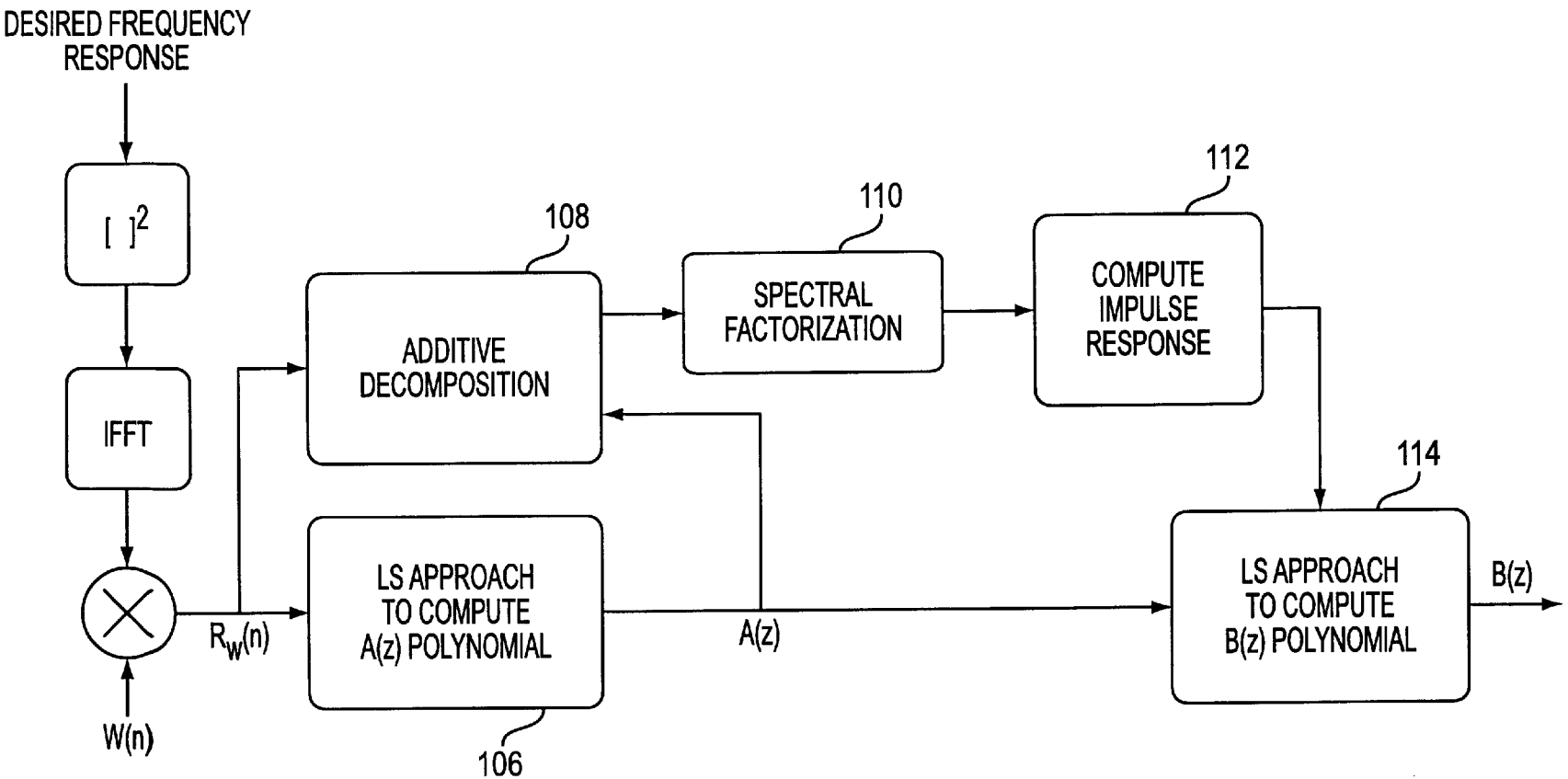
FIG. 4 is a diagram of the filter design process according to the present invention.

FIG. 4 illustrates the method according to this invention, wherein the desired frequency response is specified, the denominator coefficients A(z) are determined according to a least squares approach at 106, based on non-recursive correlation coefficients Rw(n) computed by inverse Fourier Transformation (IFFT) of the specified frequency response. The numerator polynomial is determined by additive decomposition at 108, spectral; factorization is applied at 110 to enable the impulse response to be calculated at 112, and the method of least squares is used to determine the final denominator polynomial B(z) at 114.

This post-filter described above has a flat frequency response that overcomes the spectral tilt and other problems present in conventional post-filters as mention earlier herein. In order to view the differences between this and conventional post-filters, the frequency responses of these filters applied to the LPC spectrum shown in FIG. 1, are given in FIG. 5.

Figure 5:
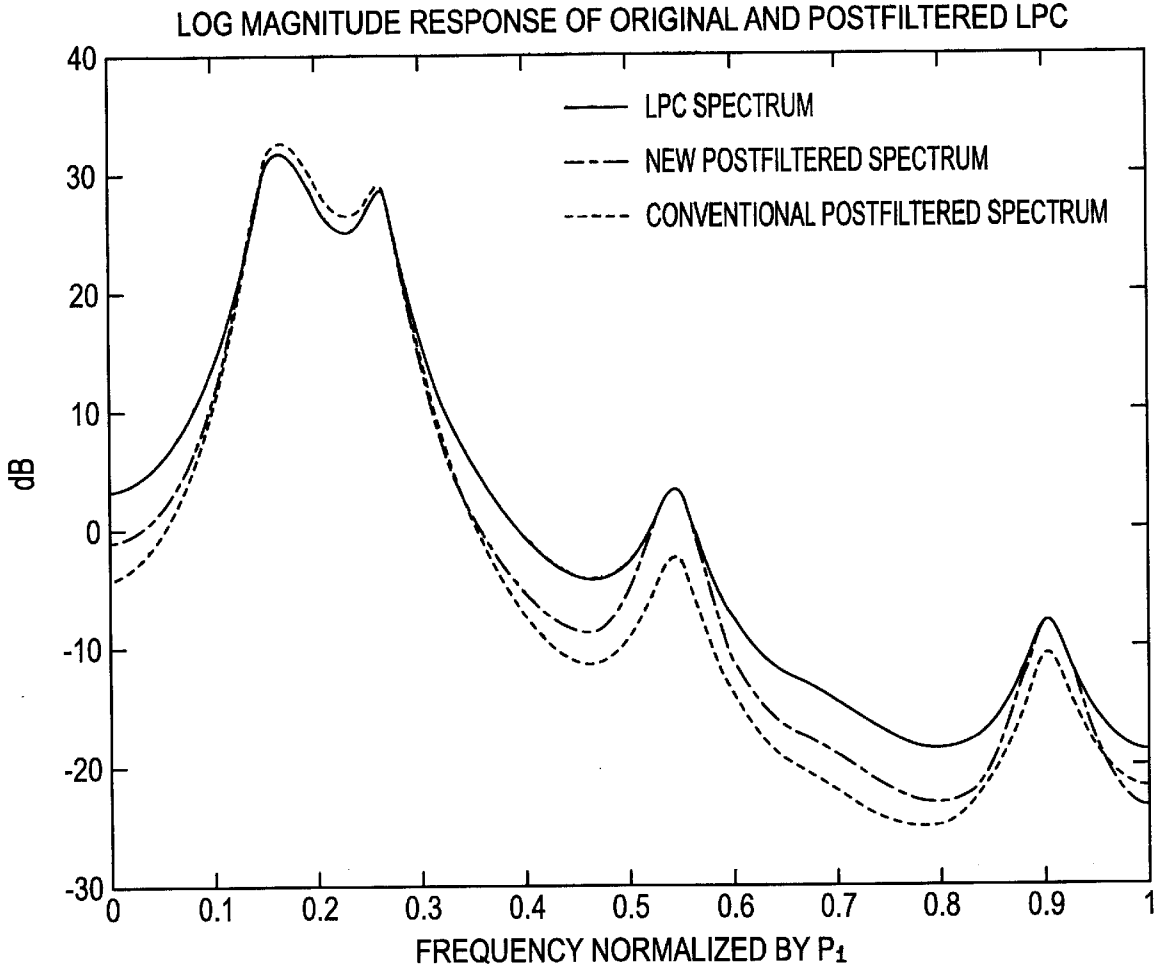
FIG. 5 is an illustration of the post-filtered LPC spectra in accordance with a filter of this invention and in comparison to a conventional post filter.

The conventional post-filter uses $\alpha$=0.8, $\beta$=0.5 and $\mu$=0.5 as suggested by Chen, cited above. From FIG. 3, it is clear that the formant peaks are maintained to be flat in the frequency response of the new MYW post-filter. However, the conventional post-filter is not flat at formant peaks. The new and the conventional post-filtered LPC spectra are shown in FIG. 5: For the conventional post-filter, it is clear that there is a spectral tilt compared with the original LPC spectrum. For the new post-filter, there is not any spectral tilt at all. The new filter preserves the formant peaks and attenuates the nulls which is the desired phenomenon. In addition, the attenuation of nulls can be more controllable in the new post-filter than in the conventional post-filter.

Figure 6:
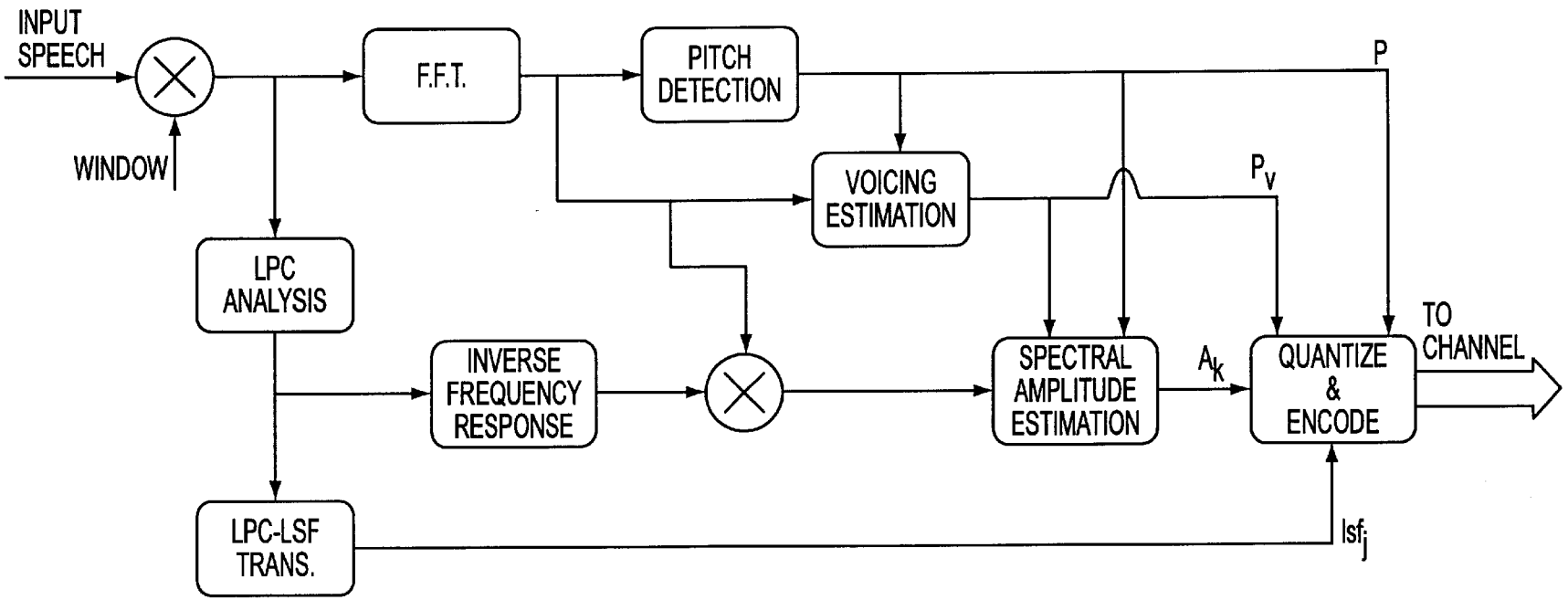
FIGS. 6 and 7 illustrate a HE-LPC encoder and decoder with which the present invention may be used.
Figure 7:
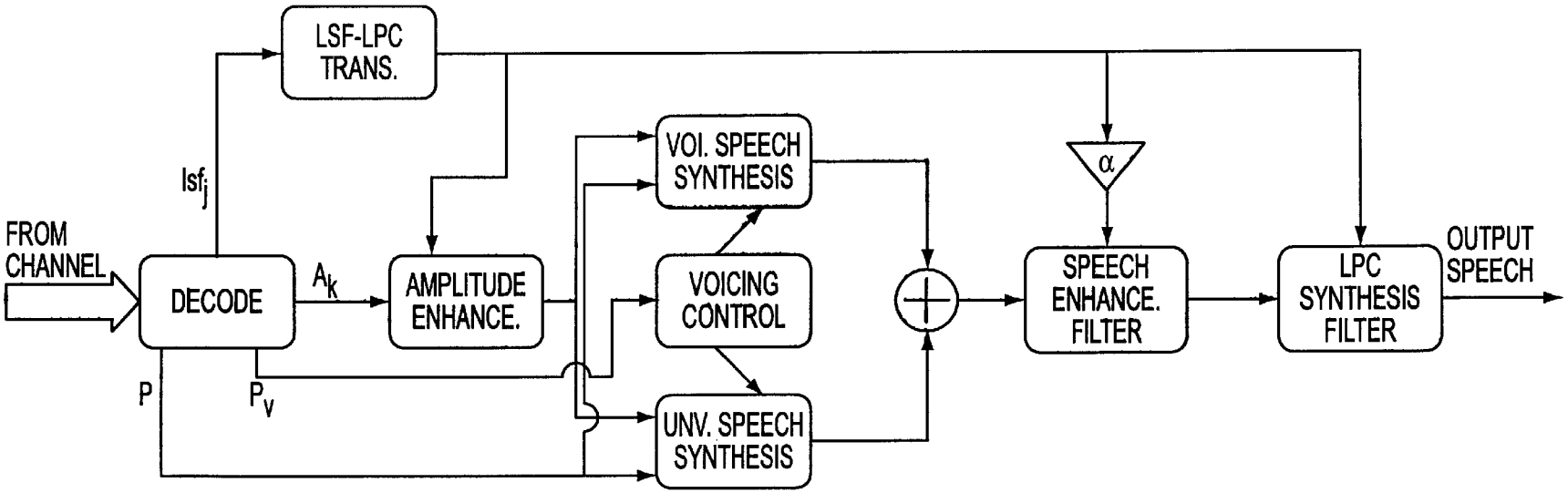

The post-filter according to this invention has been incorporated into a 4 kb/s Harmonic Excitation Linear Predictive Coder (HE-LPC). In the HE-LPC coder, the approach to represent the speech signals s(n) is to use the speech production model in which speech is viewed as the result of passing an excitation, e(n) through a linear time-varying filter (LPC), h(n), that models the resonant characteristics of the speech spectral envelope. This is described further by S. Yeldener, A. M. Kondoz and B. G. Evans, "Multi-Band Linear Predictive Speech Coding at Very Low Bit rates", IEEE Proc. Vis. Image and Signal Processing, October 1994, Vol. 141, No. 5, pp. 289–295, and by S. Yeldener, A. M. Kondoz and B. G. Evans, "Sine Wave Excited Linear Predictive Coding of Speech", Proc. Int. Conf. On Spoken Language Processing, Kobe, Japan, November 1990, pp. 4.2.1–4.2.4. The h(n) is represented by 14 LPC coefficients which are quantized in the form of Line Spectral Frequency (LSF) parameters. In the HE-LPC speech coder, the excitation signal e(n) is specified by a fundamental frequency or pitch, its spectral amplitudes, and a voicing probability. The voicing probability defines a cut-off frequency that separates low frequency components as voiced and high frequency components as unvoiced. The computed model parameters are quantized and encoded for transmission. At the receiving end, the information bits are decoded, and hence, the model parameters are recovered. At the decoder, the voiced part of the excitation spectrum is determined as the sum of harmonic sine waves. The harmonic phases of sine waves are predicted using the phase information of the previous frames. For the unvoiced part of the excitation spectrum, a white random noise spectrum normalized to unvoiced excitation spectral harmonic amplitudes is used. The voiced and unvoiced excitation signals are then added together to form the overall synthesized excitation signal. The resultant excitation is then shaped by the linear time-varying filter, h(n), to form the final synthesized speech. Finally, the synthesized speech was passed through the new and conventional post-filters, in order to evaluate the performance of each of these filters. The overall arrangement of the HE-LPC encoder is illustrated in FIG. 6, with the decoder illustrated in FIG. 7.

In order to measure the subjective performance of the new and conventional post-filters, various listening tests were conducted. For this purpose, two post-filters were separately used in the same 4 kb/s HE-LPC coder for subjective performance evaluation purposes. In the first experiment, an MOS test was conducted. In this test, 8 sentence pairs for 4 speakers (2 male and 2 female speakers) were processed by the two 4 kb/s coders. Altogether 24 listeners performed this test. Both one and two tandem connections of these coders are evaluated and the MOS results are given in Table 1.

TABLE 1

MOS scores for conventional and new post-filters

| Coder | MOS Scores 1 Tandem | MOS Scores 2 Tandem |
|---|---|---|
| 4 kb/s Coder With Conventional Post-filter | 3.41 | 2.40 |
| 4 kb/s Coder With New Post-filter | 3.55 | 2.75 |

From these test results, it is clear that, the 4 kb/s coder with the new post-filter performed better than the coder with conventional post-filter. The improvement of speech quality attributable to the new post-filter is very substantial in the 2 tandem connection case. To further verify the performance of the new post-filter, a pair-wise listening test was conducted to compare the 4 kb/s coders with the conventional and new post-filters. For this test, 12 sentence pairs for 6 speakers (3 male and 3 female speakers) were processed by the two 4 kb/s coders (for 1 and 2 tandem connection conditions) and the sentence pairs were presented to the listeners in a randomized order. Sixteen listeners performed this test. The overall test results for 1 and 2 tandem connections are shown in Tables 2 and 3, respectively.

TABLE 2

Pair-wise test results for 1 tandem connection

| Preferences No of Votes | Preferences % | Preferred Coder |
|---|---|---|
| 21 | 10.9 | New Post-filter (Strong) |
| 60 | 31.3 | New Post-filter |

TABLE 2-continued

| Pair-wise test results for 1 tandem connection | | |
|---|---|---|
| Preferences | | |
| No of Votes | % | Preferred Coder |
| 75 | 39.1 | Similar |
| 29 | 15.1 | Conventional Post-filter |
| 7 | 3.6 | Conventional Post-filter (strong) |

TABLE 3

| Pair-wise test results for 2 tandem connection | | |
|---|---|---|
| Preferences | | |
| No of Votes | % | Preferred Coder |
| 30 | 15.6 | New Post-filter (Strong) |
| 79 | 41.1 | New Post-filter |
| 65 | 33.9 | Similar |
| 16 | 8.3 | Conventional Post-filter |
| 2 | 1.1 | Conventional Post-filter (strong) |

The results are very conclusive. In the 1 tandem connection case, the new post-filter was found to be slightly better than the conventional post-filter. In the 2 tandem connection case, the new post-filter was found to be superior over the conventional post-filter.

It will be appreciated that various changes and modifications can be made to the filter described above without departing from the spirit and scope of the invention as defined in the appended claims.

What is claimed is:

1. A method of designing a filter for filtering a speech signal, said method comprising the steps of:

determining pole information comprising the locations of poles of an LPC spectrum of said speech signal;

estimating the location and bandwidth of formants of said speech signal based on said pole information;

estimating filter coefficients;

comparing a desired filter response characteristic to a filter response characteristic resulting from said estimated filter coefficients to obtain a difference value; and adjusting said filter coefficients to minimize said difference value.

2. A method according to claim 1, wherein said adjusting step comprises minimizing said difference value according to a least squares method.

3. A method according to claim 1, wherein said step of estimating the location and bandwidth of formants comprises:

arranging at least some of said poles in a predetermined order;

calculating a magnitude of said LPC spectrum at at least some of said arranged poles;

calculating first and second slopes $m_1$ and $m_2$, respectively, of said LPC spectrum on either side of at least some of said arranged poles; and estimating said location and bandwidth of formants based on the location, magnitude and neighboring slopes of said LPC spectrum poles.

4. A method according to claim 3, wherein said step of estimating said location and bandwidth of formants comprises:

(i) estimating first and second adjacent poles to represent different formants if the slope at said first pole is negative in a first direction toward said second pole and if the slope at said second pole is positive in said first direction coming from said first pole.

5. A method according to claim 4, wherein said step of estimating said location and bandwidth of formants further comprises:

(ii) estimating first and second adjacent poles to represent a common formant if the criteria of step (i) are not met and if a difference in magnitudes of said LPC spectrum is less than a threshold value.

6. A method according to claim 5, wherein said threshold value is approximately 3 dB.

7. A method according to claim 5, wherein said step of estimating said location and bandwidth of formants further comprises:

(iii) estimating the larger of said first and second poles to represent a formant if the criteria of steps (i) and (ii) are not met.

8. A method according to claim 7, wherein said step of estimating the location and bandwidth of formants further comprises:

assigning a bandwidth to each formant; and combining two formants into a signal estimated formant if their assigned bandwidths overlap one another.

9. A method according to claim 1, wherein said filter is a modified Yule Walker filter having an impulse response of the form $$\frac{B(z)}{A(z)} = \frac{b(1) + b(2)z^{-1} + \cdots + b(N)z^{-(N-1)}}{1 + a(1)z^{-1} + \cdots + a(N)z^{-(N-1)}} \quad (3)$$

where N is the order of the filter, and (a(1), a(2), . . . , a(N)) and (b(1), b(2), . . . , b(N)) are filter coefficients.

10. A method according to claim 9, wherein said step of estimating said filter coefficients comprises estimating said coefficients (a(1), a(2), . . . , a(N)) according to Modified Yule-Walker equations using non-recursive correlation coefficients computed by inverse Fourier transformation of the desired filter frequency response.

11. A method according to claim 9, wherein said step of estimating said filter coefficients comprises estimating said coefficients (b(1), b(2), . . . , b(N)) according to the steps of:

computing a numerator polynomial corresponding to an additive decomposition of the power frequency response;

evaluating a complete frequency response of said filter;

estimating an impulse response of said filter; and adjusting said numerator polynomial in accordance with a least squares fit to said impulse response.

12. A method according to claim 11, wherein said impulse response of said filter is estimated according to a spectral factorization technique.

13. A method according to claim 1, wherein said step of estimating said filter coefficients comprises assigning a unity gain factor to said filter in the region of each formant.

14. A method according to claim 13, wherein said step of estimating said filter coefficients further comprises assigning an attenuation factor $\tau$ to said filter outside of a region of each formant.

15. A method according to claim 14, wherein said attenuation factor $\tau$ is approximately 0.6.

16. A method according to claim 14, wherein said attenuation factor $\tau$ can change from one frame to another of said speech signal.

17. A filter for filtering a speech signal in accordance with filter coefficients, said having a filter employing filter coefficients determined by a method comprising the steps of:

determining pole information comprising the locations of poles of an LPC spectrum of said speech signal;

estimating the location and bandwidth of formants of said speech signal based on said pole information;

estimating filter coefficients;

comparing a desired filter response characteristic to a filter response characteristic resulting from said estimated filter coefficients to obtain a difference value; and adjusting said filter coefficients to minimize said difference value.

18. A filter according to claim 17, wherein said adjusting step comprises minimizing said difference value according to a least squares method.

19. A filter according to claim 17, wherein said step of estimating the location and bandwidth of formants comprises:

arranging at least some of said poles in a predetermined order;

calculating a magnitude of said LPC spectrum at at least some of said arranged poles;

calculating first and second slopes $m_1$ and $m_2$, respectively, of said LPC spectrum on either side of at least some of said arranged poles; and estimating said location and bandwidth of formants based on the location, magnitude and neighboring slopes of said LPC spectrum poles.

20. A filter according to claim 19, wherein said step of estimating said location and bandwidth of formants comprises:

(i) estimating first and second adjacent poles to represent different formants if the slope at said first pole is negative in a first direction toward said second pole and if the slope at said second pole is positive in said first direction coming from said first pole.

21. A method according to claim 20, wherein said step of estimating said location and bandwidth of formants further comprises:

(ii) estimating first and second adjacent poles to represent a common formant if the criteria of step (i) are not met and if a difference in magnitudes of said LPC spectrum is less than a threshold value.

22. A method according to claim 21, wherein said threshold value is approximately 3 dB.

* * * * *